US006872905B2

(12) United States Patent
Kuepper et al.

(10) Patent No.: US 6,872,905 B2
(45) Date of Patent: Mar. 29, 2005

(54) PUSHBUTTON FOR LATCHING AND MOMENTARY CONTACT FUNCTIONS

(75) Inventors: Wilfried Kuepper, Bad Neuenahr-Ahrweiler (DE); Angela Hilgers, Alfter (DE)

(73) Assignee: Moeller GmbH, Bonn (DE)

( * ) Notice: Subject to any disclaimer, the term of this patent is extended or adjusted under 35 U.S.C. 154(b) by 614 days.

(21) Appl. No.: 09/914,139

(22) PCT Filed: Dec. 13, 2000

(86) PCT No.: PCT/EP00/12638

§ 371 (c)(1),
(2), (4) Date: Aug. 23, 2001

(87) PCT Pub. No.: WO01/48769

PCT Pub. Date: Jul. 5, 2001

(65) Prior Publication Data

US 2003/0150701 A1 Aug. 14, 2003

(30) Foreign Application Priority Data

Dec. 23, 1999 (DE) ..... 199 62 291

(51) Int. Cl.[7] ..... H01H 3/20
(52) U.S. Cl. ..... 200/430; 200/4; 200/18
(58) Field of Search ..... 200/430, 4, 16 A, 200/17 R, 18

(56) References Cited

U.S. PATENT DOCUMENTS 4,175,220 A 11/1979 Johnston et al.
4,737,608 A 4/1988 Jones

FOREIGN PATENT DOCUMENTS

| | | |
|---|---|---|
| DE | 1928788 | 2/1970 |
| DE | 2903066 | 7/1980 |
| DE | 3412518 | 10/1985 |
| DE | 3541390 | 8/1986 |
| DE | 3521155 | 12/1986 |
| GB | 1299727 | 12/1972 |

*Primary Examiner*—Kyung Lee
(74) *Attorney, Agent, or Firm*—Davidson, Davidson & Kappel, LLC

(57) ABSTRACT

The invention relates to a modular selection button for actuating contact elements. Said button comprises a housing (6), spring-loaded switching lugs (81) and according to requirements a control switch (10), a rotary knob (11) or a key-operated switch (2) as a rotating actuator, in addition to one of several transmission members (4; 4'; 5; 5'), which transmits the movement from the actuator (10; 11; 2) to the switching lugs (81) via switching cam elements (42; 52). Stops and counter-stops which are fixed and displaceable respectively with respect to the housing (6) form various stop elements that can be used to select the number of switching positions and actuation modes. The various stops are configured on the housing (6), on the key-operated actuator (2) and on the second stop slides (92) that are to be inserted into the housing (6). The various counter-stops are configured in the control switch (10), in the rotary knob (11) and on the transmission members (4; 4'; 5; 5').

34 Claims, 3 Drawing Sheets

PUSHBUTTON FOR LATCHING AND MOMENTARY CONTACT FUNCTIONS

BACKGROUND

The present invention relates to a modular selection button for actuating contact elements, the modular selection button including a rotating handle and at least one switch plunger supported in a housing.

German Patent Publication DE-C2-35 41 390 describes such a selection button featuring a rotating handle, a transmission member, and stops. The substantially cylindrical transmission member is non-rotatably coupled to the handle, carries an axially acting switching cam which is closed upon itself as well as a stop boss, and is supported in a housing. To limit the angle of rotation, the stops cooperate with the stop boss and are formed in stop rings of which one is replaceably and non-rotatably arranged in the housing. Located between the stops is a circular path segment which, from stop ring to stop ring, spans a different angle and with which in each case the stop boss engages. The switching cam is configured as a projecting shoulder at the lateral surface of the transmission member and cooperates with at least one switch plunger of a contact element. The switch plunger is arranged in the housing in a manner that it is non-rotatable as well as axially movable against the action of a spring and intended to actuate the contact plunger of the contact element. The direction of rotation of the handle determines which of the two switch plungers is moved. The rotation of the handle which is limited by the respective stop ring determines, on one hand, the number of possible switching positions, that is two or three switching positions and, on the other hand, the actuation mode which is the momentary contact mode, i.e., monostable, when rotated by 45° whereas it is the latching mode, i.e., bistable, when rotated by 90°. It is a disadvantage that, for changing the actuation mode, the user has to disassemble the selection button to replace the stop ring.

SUMMARY OF THE INVENTION

An object of the present invention is to provide a modular selection switch in which making changes in the actuation mode is relatively easy and which has a relatively large number of variants.

The present invention provides a modular selection button for actuating contact elements. The selection button includes:

a housing;

a rotating handle;

a disk-shaped transmission member supported in the housing and non-rotatably coupled to the handle, the transmission member including at least one axially projecting and axially acting switching cam element disposed on a rear side thereof;

a first stop device including at least one first stop disposed the housing and fixed relative to the housing and a first counterstop disposed on the handle and rotatable using the handle, the first stop device configured to limit a first angle of rotation of the handle, the first stop device useable for a first latching mode of the selection button, the first latching mode having a first resting position, a first clockwise latched rotated position and a first counterclockwise latched rotated position;

a second stop device including at least one second stop disposed on the housing and fixed relative to the housing and a second counterstop disposed on the transmission member and rotatable using the handle, the second stop device limiting a second angle of rotation of the handle, the second stop device useable for a second latching mode of the selection button, the second latching mode having a second resting position and a second clockwise latched rotated position; and at least one switch plunger supported in the housing so as to be non-rotatable and axially movable against a spring device, the at least one switch plunger including a symmetrically formed end face configured to cooperate with the at least one switching cam element, the transmission member being capable of latching onto the switch plunger using the end face and the switching cam element when a predetermined angle of rotation of the handle is reached.

According to a first embodiment of the present invention, there are varied possibilities both for the type of handles to be used and for the actuation modes the disk-shaped design of the transmission member featuring switching cam elements projecting from the rear side and due to the formation of the permanently existing first and second stop devices and the fifth stop device, which may be provided as required. Finger-grip knobs, rotary knobs or equally acting actuating elements can be used as rotating handles. The selection switch can be provided with two or three switching positions and in this context, in turn, with latching or momentary contact actuation mode. Without having to be disassembled, the selection button can be easily programmed from the latching into the momentary contact actuation mode or vice versa by inserting or removing two stop slides on the rear side.

According to a second embodiment of the present invention, there are varied possibilities for the actuation modes due to the disk-shaped design of the transmission member featuring switching cam elements projecting from the rear side and due to the formation of the permanently existing third stop device and the fourth or fifth stop device, which may be provided as required. More or less complex key actuators are used as rotating handles. The selection switch can be provided with two or three switching positions and in this context, in turn, with latching or momentary contact actuation mode. Moreover, it is possible for the latching actuation mode to be modified in such a manner that, in the rotated position, the key is either released such as in the resting position or retained, that is to say that it is either possible or not possible to remove the key in the rotated position. Without having to be disassembled, the selection button can be easily programmed from the latching into the momentary contact actuation mode or vice versa by inserting, removing or mutually exchanging first or second stop slides on the rear side or, when in the latching mode, from the mode with releasable key into the mode with retained key or vice versa.

According to a third embodiment of the present invention, there are varied possibilities both for the type of handles to be used and for the actuation modes due to the disk-shaped design of the transmission member featuring switching cam elements projecting from the rear side and due to the formation of the permanently existing first to third stop means and the fourth or fifth stop means, which may be provided as required. Finger-grip knobs, rotary knobs, equally acting actuating elements, or more or less complex key actuators can be used as rotating handles. The selection switch can be provided with two or three switching positions and in this context, in turn, with latching or momentary contact actuation mode. When using a key actuator it is moreover possible for the latching actuation mode to be modified in such a manner that, in the rotated position, the key is either released such as in the resting position or retained, that is to say that it is either possible or not possible to remove the key in the rotated position. Without having to be disassembled, the selection button can be easily programmed from the latching into the momentary contact actuation mode or vice versa by inserting, removing or mutually exchanging first or second stop slides on the rear side or, when in the latching mode, from the mode with releasable key into the mode with retained key or vice versa. Thus, the third embodiment combines the features and advantages of the first and second embodiments.

In certain embodiments of the present invention, provision may be made for strip-like first or second stop slides provided with latching devices, the second stop slide differing from the first stop slide only by a notch in the front part for forming the respective stop faces.

In certain embodiments of the present invention, provision may be made for in each case paired switch plungers and first, second, or third stops as well as first or second stop slides can be used. If the selection button is provided with three switching positions, it turns out to be expedient for this purpose to use a first transmission member having in each case mirror-symmetric pairs of switching cam elements and to use fourth counterstops; however, if the selection button is provided with two switching positions, it turns out to be expedient to use a second transmission member featuring pairs of switching cam elements and to use second counterstops whose pair elements are in each case configured to be diagonally opposed and antisymmetric, that is laterally reversed.

In certain embodiments of the present invention, provision may be made for a sixth stop device to provide a definite resting position when the selection button is provided with two switching positions.

Finger-grip knobs, rotary knobs, or similar actuating elements are advantageously to be connected to the transmission member in a positive locking manner via rib- and slot-shaped segments. A further advantage follows from this in the case of two switching positions in that the handle can be connected to the transmission member in at least two engagement positions with respect to the housing. In this manner, it is possible, for example, to optionally implement either a vertical resting position and a rotated position which is angularly offset therefrom or a resting position which is angularly offset from the vertical and a rotated position of the handle which is symmetrically angularly offset therefrom.

By providing the transmission member with a light aperture, the selection button is made suitable for use with light-emitting elements.

In conjunction with a key actuator, in certain embodiments of the present invention the cylinder lock is non-rotatably connected to the housing as an additional part thereof via a cover, the lock core which can be rotated using the key is connected to the transmission member in a positive locking manner, and the third stop device acts between the fixed cylinder lock and the transmission member.

BRIEF DESCRIPTION OF THE DRAWINGS

Further details and advantages of the present invention follow from the following exemplary embodiment which will be explained on the basis of Figures.

DETAILED DESCRIPTION

Figure 1:
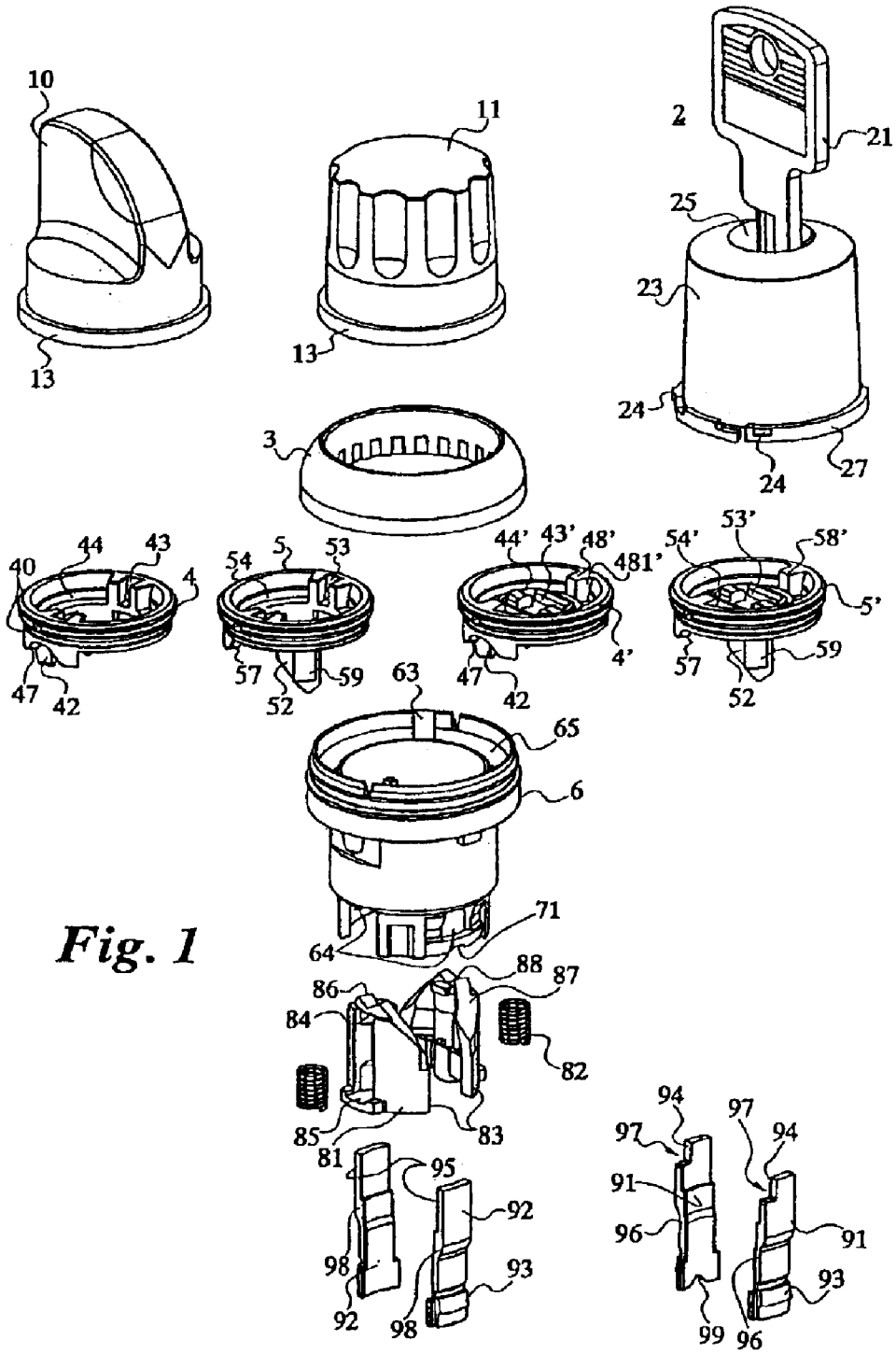
FIG. 1 shows the totality of a selection button according to the present invention in a perspective, pulled-apart view.

FIG. 1 shows the component parts for the totality of all three of the modular selection button according to the present invention, namely: a finger-grip knob 10, a rotary knob 11, and a key actuator 2 as a rotating handle, a front ring 3, a first transmission member 4, a second transmission member 5, a modified first transmission member 4', a modified second transmission member 5', a housing 6, switch plungers 81 which each have one pressure spring 82, first stop slides 91 and second stop slides 92.

In the selection button according to the first embodiment, there exist, depending on the requirement, finger-grip knob 10 or rotary knob 11, front ring 3; depending on the requirement, first or second transmission member 4 or 5, housing 6, one or two switch plungers 81 with their pressure springs 82; and, depending on the requirement, none, one, or two second stop slides 92.

In the selection button according to the second embodiment, there exist key actuator 2, front ring 3; depending on the requirement, modified first or second transmission member 4' or 5', housing 6, one or two switch plungers 81 with their pressure springs 82; and, depending on the requirement, none, one, or two first or second stop slides 91 or 92.

In the selection button according to the third embodiment, there exist, depending on the requirement, finger-grip knob 10, rotary knob 11, or key actuator 2, front ring 3; depending on the requirement, first or second transmission member 4 or 5 or modified first or second transmission member 4' or 5', one or two switch plungers 81 with their pressure springs 82; and, depending on the requirement, none, one, or two first or second stop slides 91 or 92.

Since the three embodiments are the same in many features and effects, these features and effects will be described in the following for two or all of the three embodiments together, correspondingly.

Figure 2:
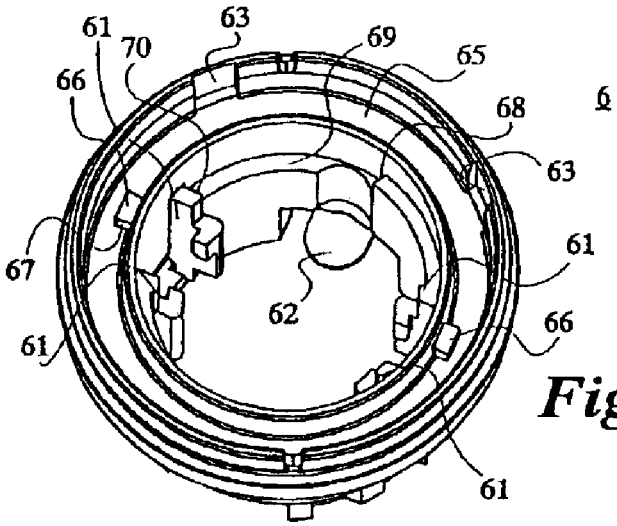
FIG. 2 shows an enlarged view from a different perspective of the housing shown in FIG. 1.

The two switch plungers 81 are inserted into housing 6 on the rear side, two widely spaced guide strips 61 in the interior of the essentially cylindrical housing 6 (FIG. 2) in each case embracing the two outer edges 83 of the respective switch plungers in a guiding and retaining manner. Helical pressure springs 82 are each braced between a first abutment 84 in switch plunger 81 and a second abutment 62 in housing 6 so that switch plungers 81 are biased in the direction of the handle by pressure springs 82. A third abutment 85 located opposite first abutment 84 in switch plunger 81 limits the movement in the direction of the handle by stopping at the rear side of second abutment 62. Disk-shaped transmission member 4, 4', 5 or 5', is inserted into housing 6 from the front. Subsequent to placing handle 10, 11, or 2 onto housing 6, front ring 3 is slipped over handle 10, 11, or 2 and snapped onto housing 6 at the front via usual snap-in locking elements. Thus, handle 10, 11, or 2 is connected to the housing in a manner that it cannot be lost. In this connection, finger-grip knob 10 or rotary knob 11, via a rear guide collar 13, rotatably rests in a front guide groove 65 of the housing, whereas key actuator 2, via a rear retaining collar 27, rests in the guide groove in a non-rotatable manner. Stop slides 91 and 92 have a strip-like design and, at their rear part, feature radially projecting latching means 93 via which they engage with corresponding window-like mating latching means 64 of housing 6 after being inserted from behind between two narrowly spaced guide strips 61, respectively. First transmission member 4 and second transmission member 5 are respectively provided with a centrical light aperture 45 or 55 (FIG. 5 and FIG. 6) which allows finger-grip knob 10 or rotary knob 11 to be illuminated by a light source connected to the selection button on the rear side. Transmission members 4, 4', 5 and 5' are equipped with ring-shaped seals 40 on the edges which protect the interior of the selection button from entering moisture and compensate for tolerances between the movable parts.

Figure 6:
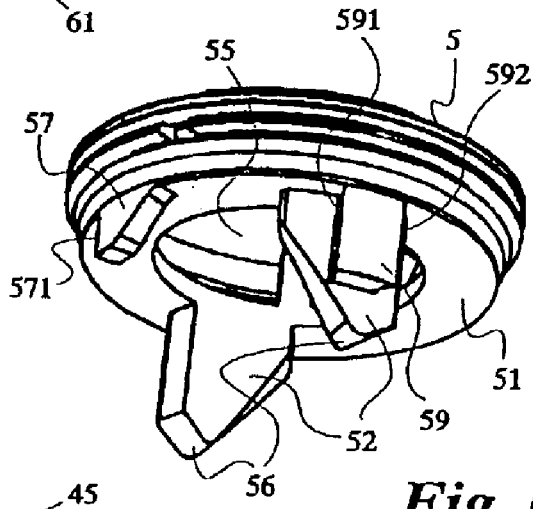
FIG. 6 shows an enlarged view from a different perspective of the second transmission member shown in FIG. 1.
Figure 5:
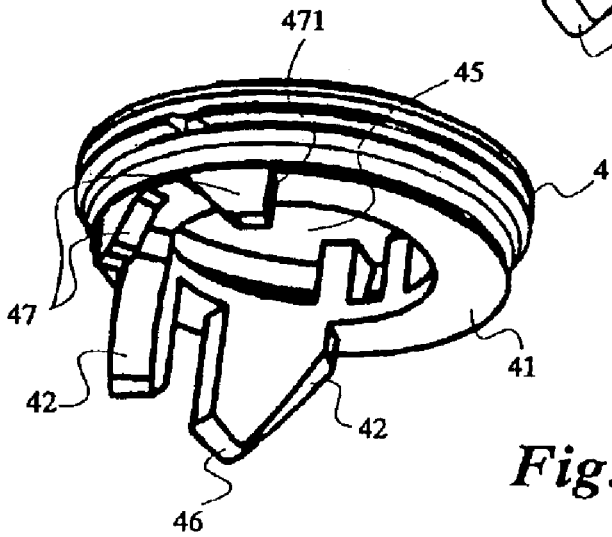
FIG. 5 shows an enlarged view from a different perspective of the first transmission member shown in FIG. 1.
Figure 3:
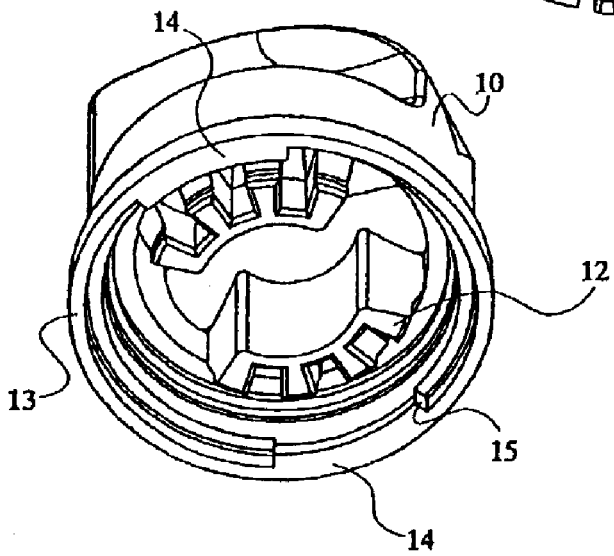
FIG. 3 shows an enlarged view from a different perspective of the finger-grip knob shown in FIG. 1.

According to FIG. 1 and FIG. 5 or FIG. 6, two axially projecting switching cam elements 42 or 52 are respectively formed on rear side 41 or 51 of first transmission member 4 or 4' or of the second transmission member 5 or 5', the switching cam elements cooperating with front end faces 86 of switch plungers 81 in such a manner that, when transmission member 4, 4', 5 or 5' is rotated out of its resting position, switch plungers 81 are moved toward the rear against the action of pressure springs 82 for actuating contact elements which are not shown. Formed on finger-grip knob 10 and on rotary knob 11 on the rear side are mutually opposing rib segments 12 (FIG. 3) which engage in a positive-locking manner with correspondingly configured mutually opposing slot segments 43 on front side 44 of first transmission member 4 or in slot segments 53 on front side 54 of second transmission member 5 during the placement of finger-grip knob 10 or rotary knob 11. In this manner, a rotary motion of finger-grip knob 10 or rotary knob 11 is transmitted to first or second transmission member 4 or 5, respectively.

Figure 4:
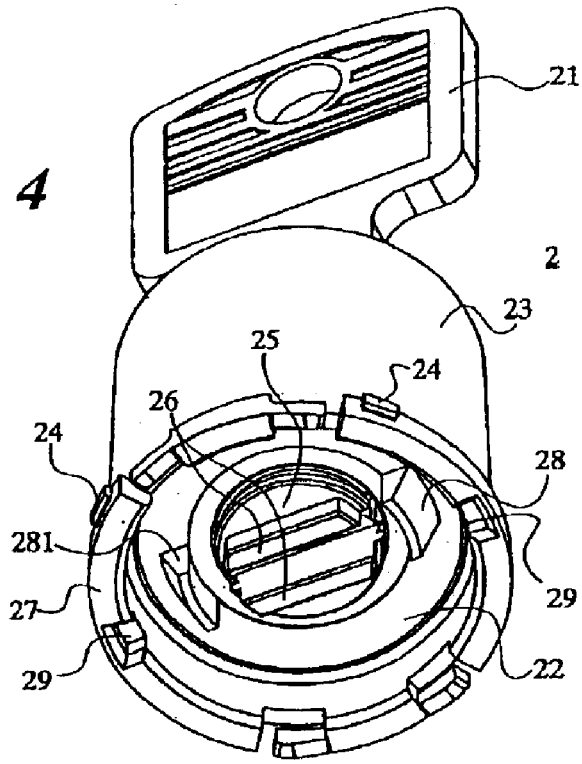
FIG. 4 shows an enlarged view from a different perspective of the key actuator shown in FIG. 1.

According to FIG. 1 and FIG. 4, key actuator 2 is composed of a key 21 and a cylinder lock 22 which is fixed in a cover 23 in a positive locking and therefore unrotatable manner. Cover 23 features two noses 24 on the edge of its collar 27, and housing 6 has two correspondingly configured grooves 63 in the upper edge area, via which grooves cover 23, in turn, is mounted in housing 6 in its correct position. Diametrically opposing recesses 29 on the rear side of collar 27, in cooperation with first stops 66 in guide groove 65 of housing 6, effect the non-rotatability of cover 23 with cylinder lock 22 in housing 6, hock core 25, which is to be rotated by means of the key, features two strip-like formations 26 on its rear side, the strip-like formations engaging in a positive locking manner with correspondingly configured recesses 43' or 53' on front side 44' or 54' of modified first or second transmission member 4' or 5', respectively. In this manner, a rotary motion is transmitted from key 21 to modified first or second transmission member 4' or 5', respectively.

When using finger-grip knob 10 or rotary knob 11 as a handle, the selection button can be provided with three switching positions, namely with a middle resting position as well as one clockwise and one counterclockwise rotated position, respectively. In the case of this variant, first transmission member 4 shown in FIG. 1 and FIG. 5 is used whose switching cam elements 42 mutually oppose each other at an acute angle. In the resting position, switching cam elements 42 are situated in the middle between the two switch plungers 81. When rotating finger-grip knob 10 or rotary knob 11 in one or in the other direction, in each case one of the two switching cam elements 42 applies pressure to an in each case abutting slanted surface 87 of end face 86 of appertaining switch plunger 81 against its pressure spring 82. If no stop slides are inserted, specific switching cam element 42, with its cam tip 46, reaches the region of a latching recess 88 of end face 86 of appertaining switch plunger 81. The selection button remains in this latched rotated position until it is removed from this position by an intentional actuation. To limit the angle of rotation in both directions, provision is made for a first stop device which includes two diametrically opposing first stops 66 which are formed in guide groove 65 of housing 6 in a nose-shaped manner and directed radially outward and of two diametrically opposing first counterstops 14 which are formed on guide collar 13 of finger-grip knob 10 or of rotary knob 11 as ring segments in a manner that they are directed radially inward, the both radially and axially running side faces 67 of first stops 66 cooperating with corresponding side faces 15 of first counterstops 14, respectively.

By inserting second stop slides 92 into housing 6, provision is made for a fifth stop device which takes effect before the first stop device when the selection button is rotated out of the resting position. The fifth stop device includes diametrically opposing second stop faces 95 which are formed by the front part of narrow side 98 of formed second stop slides 92 which narrow side opposes the respective direction of rotation, and of two fourth counterstops 47 which are formed on rear side 41 of first transmission member 4 in a manner that they project radially and symmetrically oppose each other at an acute angle, second stop faces 95 cooperating with the both radially and axially running edge faces 471 of counterstops 47 which are angularly offset from switching cam elements 42. In this manner, the angle of rotation of the selection button is limited so that it is no longer possible for the respective switching cam element 42 to reach, with its cam tip 46, the region of latching recess 88 of end face 86 of appertaining switch plunger 81. In this case, the selection button features the momentary contact mode in both rotated positions since, after releasing handle 10 or 11, the selection button automatically returns from the rotated position to the resting position through the action of pressure springs 82 and the interplay of slanted surfaces 87 of switch plungers 81 with switching cam elements 42.

When using finger-grip knob 10 or rotary knob 11 as a handle, the selection button can also be provided with two switching positions, namely with a resting position and a clockwise rotated position. In the case of this embodiment, second transmission member 5 shown in FIG. 1 and FIG. 6 is used whose switching cam elements 52 diametrically oppose each other in a manner that they are laterally reversed, i.e., offset by 180°. In the resting position, switching cam elements 52 in each case abut on the slanted surface 87 of the two switch plungers 81 which runs ahead in the direction of rotation. When rotating finger-grip knob 10 or rotary knob 11, each of the two switching cam elements 52 applies pressure to respective slanted surface 87 of appertaining switch plunger 81 against its pressure spring 82. If no stop slides are inserted, specific switching cam element 52, with its cam tip 56, reaches the region of a latching recess 88 of end face 86 of appertaining switch plunger 81. In this manner, the rotated position is latched. To limit the angle of rotation, provision is made for a second stop device including two diametrically opposing second stops 68 which each occur in the clockwise direction as end face of two sector-shaped recesses 69 diametrically formed in housing 6 and of two diametrically opposing second counterstops 59 which are formed on rear side 51 of second transmission member 5 in a manner that they project axially and oppose each other diametrically and that they are arranged radially outward in front of one of the switching cam elements 52, respectively, second stops 68 cooperating with corresponding edges 591 of second counterstops 59, the edges running ahead in the direction of rotation. For assuming the resting position which is brought about by pressure springs 82 and by the interplay of slanted surfaces 87 of switch plungers 81 with switching cam elements 52, the selection button is equipped with a sixth stop device including fourth stops 70 which each occur in the counterclockwise direction as end face of two sector-shaped recesses 69 and of second counterstops 59, fourth stops 70 cooperating with corresponding edges 592 of second counterstops 59, the edges running after.

To implement the momentary contact operating mode, provision is made for a fifth stop device, again by inserting a second stop slide 92 into housing 6, the fifth stop means taking effect before the second stop device when the selection button is rotated out of the resting position. In this case, the fifth stop device includes second stop face 95 of the only stop slide 92 and of a fourth counterstop 57, which is formed on rear side 51 of second transmission member 5 in a manner that it projects axially, second stop face 95 cooperating with the both radially and axially running edge face 571 of counterstop 57, which counterstop is angularly offset from switching cam elements 52. In this manner, the angle of rotation of the selection button is limited so that it is no longer possible for the switching cam elements 52 to reach, with their cam tip 56, the region of latching recesses 88 of end faces 86 of appertaining switch plungers 81.

Finger-grip knob 10 is provided with a number of rib segments 12 greater than the number of slot segments 53 of second transmission member 5. Because of this, it is possible for finger-grip knob 10 to be optionally brought into two different engagement positions with second transmission member 5. In the case of a horizontal fitting position of a selection button provided with two switching positions, finger-grip knob 10 will assume a vertical resting position (0°) in the one engagement position, and a rotated position which is angularly offset therefrom (for example, +30°) whereas, in the other engagement position, the finger-grip knob will assume a resting position which is angularly offset with respect to the vertical (for example, −15°) and a rotated position which is symmetrically angularly offset therefrom (for example, +15°).

When using key actuator 2 as a handle, the selection button can be provided with three switching positions again. In this variant, modified first transmission member 4' shown in FIG. 1 is used whose switching cam elements 42 and fourth counterstops 47 are formed identically as in above described first transmission member 4. Without a latching slide, the latching actuation mode is implemented again, the full angle of rotation being reached here, allowing key 21 to be released or removed in the rotated positions. To dimension the full angle of rotation in both directions, provision is made for a third stop device including two diametrically opposing third stops 28 which are formed on the rear side of stationary cylinder lock 22 as ring segments and in an axial direction, and of two diametrically opposing third counterstops 48' which are formed on front side 44' of modified first transmission member 4' in a nose-shaped manner and directed radially inward, corresponding radially and axially running side faces 281 of third stops 28 cooperating with corresponding side faces 481' of third counterstops 48'.

In this case, fourth counterstops 47 of first modified transmission member 4', together with second stop faces 95 of second stop slides 92 which are inserted in housing 6, form the fifth stop device for implementing the momentary contact actuation mode. Because of the limited angle of rotation, it is not possible for key 21 to be removed in the rotated positions.

By inserting first stop slides 91 in lieu of second stop slides 92, provision is made for fourth stop device which, when key actuator 2 is rotated out of the resting position, are effective already before the third stop device but after the above described fifth stop device. In this manner, again, a latching actuation mode is implemented, however, due to the still limited angle of rotation, key 21 cannot be removed in the rotated position here either since it is retained in cylinder lock 22 because of the failure to reach the full angle of rotation. The fourth stop device includes mutually opposing first stop faces 94 which are formed by the in each case rear surface of a notch 97 located at the front part of narrow side 96 of first stop slides 91 which narrow side opposes the respective direction of rotation, and of fourth counterstops 47 of modified first transmission member 4'. The two stop slides 91 have a mirror-symmetric design with respect to their narrow sides 96 as axis of symmetry and differ from second stop slides 92 basically by notches 97. One of the two first stop slides 91 is coded at the rear part with a first indentation 99 which corresponds to a second indentation 71 underneath one of mating latching devices 64 in housing 6 to enable each of the two mirror-symmetric fist stop slides 91 to be placed to the correct location of housing 6.

When using key actuator 2 as a handle, the selection button can also be provided with two switching positions. In this embodiment, modified second transmission member 5' shown in FIG. 1 is used whose switching cam elements 52, second counterstops 59, and fourth counterstop 57 are formed identically as in above described first transmission member 4. Again, key 21 is released in the rotated position with no latching slide being inserted. In the case of a latched rotated position and releasable key 21, again, the movement is limited by the third stop device, which includes third stops 28 located at cylinder lock 22 and by third counterstops 58', which are formed on front side 54' of modified second transmission member 5' and which correspond to counterstops 48' of modified first transmission member 4'. Here too, the limiting in the resting position is brought about by the sixth stop device including fourth stops 70 in housing 6 and second counterstops 59.

By inserting only one first stop slide 91 into housing 6, in cooperation with fourth counterstop 57 of modified second transmission member 5', again, provision is made for the fourth stop device which, in cooperation with cylinder lock 22, retain key 21 in the latched rotated position.

Here too, the limitation of the rotary motion in the momentary contact actuation mode is carried out by the fifth stop device including the only second stop slide 92 and fourth counterstop 57.

The present invention is not limited to the specific embodiments described above but includes all equally-acting embodiments along the lines of the present invention. Instead of the described handles, it is also possible to use other equally-acting handles such as an actuating rod which is appropriately formed at the end face and capable of being directly engaged with recesses 43' or 53' of modified first or second transmission member 4' or 5' from the front and able to be removed therefrom again. In the case of a selection button provided with three switching positions, it is also possible to use only one first stop slide 91 alone, one second stop slide 92 alone or one first and one second stop slide 91 and 92 together to implement the latching or momentary contact actuation mode only in only one corresponding direction of rotation, possibly with releasable or retained key. Simplified embodiments of the present invention can be provided for certain applications by using only one switch plunger 81. A simplification at the cost of reliability can also be achieved in that in each case only one first, second and third stop 66, 68 or 28, respectively, may be provided.

LIST OF REFERENCE NUMERALS

10 finger-grip knob
11 rotary knob
12 rib segments
13 guide collar
14 first counterstop
15 side face
2 key actuator
21 key
22 cylinder lock
23 cover
24 noses
25 lock core
26 formations
27 retaining collar
28 third stop
281 side face
29 recess
3 front ring
4 first transmission member
40 seals
41 rear side
42 switching cam elements
43 slot segments
44 front side
45 light aperture
46 cam tip
47 fourth counterstop
471 edge face
4' modified first transmission member
43' recesses
44' front side
48' third counterstop
481' side face
5 second transmission member
51 rear side
52 switching cam elements
53 slot segments
54 front side
55 light aperture
56 cam tip
57 fourth counterstop
571 edge face
59 second counterstop
591 edge running ahead
592 edge running after
5' modified second transmission member
53' recesses
54' front side
58' third counterstop
6 housing
61 guide strips
62 second abutment
63 grooves
64 mating latching means
65 guide groove
66 first stop
67 side face
68 second stop
69 recess
70 fourth stop
71 second indentation
81 switch plunger
82 pressure spring
83 outer edges
84 first abutment
85 third abutment
86 end face
87 slanted surface
88 latching recess
91 first stop slide
92 second stop slide
93 latching means
94 first stop face
95 second stop face
96 narrow side
97 notch
98 narrow side
99 first indentation

What is claimed is:

1. A modular selection button for actuating contact elements, the selection button comprising:

a housing;

a rotating handle;

a disk-shaped transmission member supported in the housing and non-rotatably coupled to the handle, the transmission member including at least one axially projecting and axially acting switching cam element disposed on a rear side thereof;

a first stop device including at least one first stop disposed on the housing and fixed relative to the housing and a first counterstop disposed on the handle and rotatable using the handle, the first stop device configured to limit a first angle of rotation of the handle, the first stop device useable for a first latching mode of the selection button, the first latching mode having a first resting position, a first clockwise latched rotated position and a first counterclockwise latched rotated position;

a second stop device including at least one second stop disposed on the housing and fixed relative to the housing and a second counterstop disposed on the transmission member and rotatable using the handle, the second stop device limiting a second angle of rotation of the handle, the second stop device useable for a second latching mode of the selection button, the second latching mode having a second resting position and a second clockwise latched rotated position; and at least one switch plunger supported in the housing so as to be non-rotatable and axially movable against a spring device, the at least one switch plunger including a symmetrically formed end face configured to cooperate with the at least one switching cam element, the transmission member latching onto the switch plunger using the end face and the switching cam element when a predetermined angle of rotation of the handle is reached.

2. The modular selection button as recited in claim 1 wherein the handle includes at least one of a finger-grip knob and a rotary knob.

3. The modular selection button as recited in claim 1 further comprising a fifth stop device including:

a fourth counterstop disposed on the transmission member and rotatable using the handle; and a second stop slide latchably insertable into the housing so as to be fixed relative to the housing, the second stop slide including a second stop face;

the fifth stop device limiting a fifth angle of rotation of the handle, an angular distance in a direction of rotation between the second stop face and the fourth counterstop being smaller than an angular distance between the first stop and the first counterstop and an angular distance between the second stop and the second counterstop.

4. The modular selection button as recited in claim 3 wherein the second stop slide has a strip-like shape and wherein the stop face is disposed on a front part of the second stop slide at a narrow side thereof with respect to a direction of rotation of the handle, the second stop slide including a first latching device disposed at a rear part thereof configured to engage a corresponding first mating latching device of the housing.

5. The modular selection button as recited in claim 4 wherein:

the at least one witch plunger includes a first and a second switch plunger diametrically opposing each other;

the at least one first stop includes two first stops diametrically opposing each other;

the at least one second stop includes two second stops diametrically opposing each other; and the fifth stop includes another second stop slide diametrically opposing the second stop slide, the another second stop slide latchably insertable into the housing so as to be fixed relative to the housing, the second stop slide including a respective second stop face, the another second stop slide having a strip-like shape, the respective stop face of the another second stop slide being disposed on a respective front part of the respective second stop slide at a respective narrow side thereof with respect to the direction of rotation of the handle, the another second stop slide including a respective first latching device disposed at a respective rear part thereof configured to engage a corresponding second mating latching device of the housing, the first and second mating latching devices having a same shape and being diametrically opposed to each other.

6. The modular selection button as recited in claim 5 wherein the at least one switching cam element of the transmission member includes two switching cam elements symmetrically offset from each other by a first acute angle and wherein the transmission element further includes axially projecting fourth counterstops angularly offset from the switching cam elements, both axially projecting fourth counterstops being symmetrically offset from each other by a second acute angle.

7. The modular selection button as recited in claim 5 wherein the at least one switching cam element of the transmission member includes two switching cam elements offset from each other by 180° and wherein the transmission element further includes axially projecting second counterstops offset from each other by 180°.

8. The modular selection button as recited in claim 1 further comprising a sixth stop device, the sixth stop device including two diametrically opposing fourth stops disposed on the housing and second counterstops disposed on the transmission member and being configured to achieve the second resting position of the selection button.

9. The modular selection button as recited in claim 1 wherein the transmission member further includes at least one slot segment disposed on a front side thereof, wherein the handle includes at least one of a finger-grip knob and a rotary knob, and wherein the handle includes rib segments disposed on a rear side thereof configured to engage the at least one slot segment in a positive-locking manner.

10. The modular selection button as recited in claim 9 wherein the handle is capable of achieving at least two engagement positions with the transmission member, the at least two engagement positions being offset from each other.

11. The modular selection button as recited in claim 1 wherein the transmission member defines a light aperture.

12. A modular selection button for actuating contact elements, the selection button comprising:

a housing;

a rotating handle including a key actuator actuatable using a key;

a disk-shaped transmission member supported in the housing and non-rotatably coupled to the handle, the transmission member including at least one axially projecting and axially acting switching cam element disposed on a rear side thereof;

a third stop device including at least one third stop disposed fixed relative to the housing and a third counterstop disposed on the transmission member and rotatable using the handle, the third stop device limiting a third angle of rotation of the handle, the third stop device useable for a latching mode of the selection button, the latching mode having a latched rotated position; and at least one switch plunger supported in the housing so as to be non-rotatable and axially movable against a spring device, the at least one switch plunger including a symmetrically formed end face configured to cooperate with the at least one switching cam element, the transmission member latching onto the switch plunger using the end face and the switching cam element when a predetermined angle of rotation of the handle is reached.

13. The modular selection button as recited in claim 12 further comprising a fourth stop device configured to limit a fourth angle of rotation of the handle, the fourth stop device including a first stop slide insertable into the housing in a latchable manner from at a rear side of the housing via an opening defined by the housing, the first stop slide including a first stop face, and wherein the transmission member further includes a fourth counterstop disposed on the transmission member, an angular distance in a direction of rotation between the first stop face and the fourth counterstop being smaller than an angular distance between the third stop and the third counterstop.

14. The modular selection button as recited in claim 12 further comprising a fifth stop device configured to limit a fifth angle of rotation of the handle, the fifth stop device including:

a second stop slide latchably insertable into the housing, the second stop slide including a second stop face; and a fourth counterstop disposed on the transmission member and rotatable using the handle.

15. The modular selection button as recited in claim 14 further comprising a fourth stop device configured to limit a fourth angle of rotation of the handle, the fourth stop device including a first stop slide insertable into the housing in a latchable manner from at a rear side of the housing via an opening defined by the housing, the first stop slide including a first stop face, and wherein:

the first and second stop slides have a respective strip-like shape, the respective stop faces being disposed at a respective narrow side with respect to the direction of rotation;

the first and second stop slides further include a respective first latching device disposed at a respective rear portion thereof and configured to engage with a respective corresponding mating second latching device of the housing; and the first stop slide defines a notch in a front part thereof configured to form the first stop face.

16. The modular selection button as recited in claim 15 wherein:

the at least one switch plunger includes a first and a second switch plunger diametrically opposing each other;

the housing further includes a first and a second third stop diametrically opposing each other and having a same shape; and the respective corresponding mating second latching device (64) of the housing includes a first and second latching device diametrically opposing each other and having a same shape.

17. The modular selection button as recited in claim 16 wherein the at least one switching cam element of the transmission member includes two switching cam elements symmetrically offset from each other by a first acute angle and wherein the transmission element further includes axially projecting fourth counterstops angularly offset from the switching cam elements, both axially projecting fourth counterstops being symmetrically offset from each other by a second acute angle.

18. The modular selection button as recited in claim 16 wherein the at least one switching cam element of the transmission member includes two switching cam elements offset from each other by 180° and wherein the transmission element further includes axially projecting second counterstops offset from each other by 180°.

19. The modular selection button as recited in claim 12 further comprising a sixth stop device, the sixth stop device including two diametrically opposing fourth stops disposed on the housing and second counterstops disposed on the transmission member and being for achieving a resting position of the selection button.

20. The modular selection button as recited in claim 12 further comprising a cylinder lock non-rotatably connected to the housing via a cover, strip-like formations on a rear side of a core of the rotatable lock engaging in a positive locking manner with recesses defined on a front side of the transmission member, the third stop being disposed on a rear side of the cylinder lock and the third counterstop being disposed on the front side of the transmission member.

21. A modular selection button for actuating contact elements, the selection button comprising:

a housing;

a rotating handle;

a disk-shaped transmission member supported in the housing and non-rotatably coupled to the handle, the transmission member including at least one axially projecting and axially acting switching cam element disposed on a rear side thereof;

a first stop device including at least one first stop disposed on the housing and fixed relative to the housing and a first counterstop disposed on the handle and rotatable using the handle, the first stop device configured to limit a first angle of rotation of the handle, the first stop device useable for a first latching mode of the selection button, the first latching mode having a first resting position, a first clockwise latched rotated position and a first counterclockwise latched rotated position;

a third stop device including at least one third stop disposed fixed relative to the housing and a third counterstop disposed on the transmission member and rotatable using the handle, the third stop device configured to limit a third angle of rotation of the handle of the handle, the third stop device useable for a third latching mode of the selection button, the second latching mode having a second latched rotated position; and at least one switch plunger supported in the housing so as to be non-rotatable and axially movable against a spring device, the at least one switch plunger including a symmetrically formed end face configured to cooperate with the at least one switching cam element, the transmission member latching onto the switch plunger using the end face and the switching cam element when a predetermined angle of rotation of the handle is reached.

22. The modular selection button as recited in claim 21 wherein the handle is at least one of a finger-grip knob, a rotary knob and a key actuator.

23. The modular selection button as recited in claim 21 further comprising a second stop device including at least one second stop disposed on the housing and fixed relative to the housing and a second counterstop disposed on the transmission member and rotatable using the handle, the second stop device configured to limit a second angle of rotation of the handle, the second stop device useable for a second latching mode of the selection button, the second latching mode having a second resting position and a second clockwise latched rotated position.

24. The modular selection button as recited in claim 21 further comprising a fourth stop device configured to limit a fourth angle of rotation of the handle, the fourth stop device including a first stop slide insertable into the housing in a latchable manner from at a rear side of the housing via an opening defined by the housing, the first stop slide including a first stop face, and wherein the transmission member further includes a fourth counterstop disposed on the transmission member, an angular distance in a direction of rotation between the first stop face and the fourth counterstop being smaller than an angular distance between the third stop and the third counterstop.

25. The modular selection button as recited in claim 21 further comprising a fifth stop device configured to limit a fifth angle of rotation of the handle, the fifth stop device including:

a second stop slide latchably insertable into the housing, the second stop slide including a second stop face; and a fourth counterstop disposed on the transmission member and rotatable using the handle.

26. The modular selection button as recited in claim 25 further comprising a fourth stop device configured to limit a fourth angle of rotation of the handle, the fourth stop device including a first stop slide insertable into the housing in a latchable manner from at a rear side of the housing via an opening defined by the housing, the first stop slide including a first stop face, and wherein:

the first and second stop slides have a respective strip-like shape, the respective stop faces being disposed at a respective narrow side with respect to the direction of rotation;

the first and second stop slides further include a respective first latching device disposed at a respective rear portion thereof and configured to engage with a respective corresponding mating second latching device of the housing; and the first stop slide defines a notch in a front part thereof configured to form the first stop face.

27. The modular selection button as recited in claim 26 wherein:

the at least one switch plunger includes a first and a second switch plunger diametrically opposing each other;

the housing further includes a first and a second third stop diametrically opposing each other and having a same shape; and the respective corresponding mating second latching device of the housing includes a first and second latching device diametrically opposing each other and having a same shape.

28. The modular selection button as recited in claim 27 wherein the at least one switching cam element of the transmission member includes two switching cam elements symmetrically offset from each other by a first acute angle and wherein the transmission element further includes axially projecting fourth counterstops angularly offset from the switching cam elements, both axially projecting fourth counterstops being symmetrically offset from each other by a second acute angle.

29. The modular selection button as recited in claim 27 wherein the at least one switching cam element of the transmission member includes two switching cam elements offset from each other by 180° and wherein the transmission element further includes axially projecting second counterstops offset from each other by 180°.

30. The modular selection button as recited in claim 21 further comprising a sixth stop device, the sixth stop device including two diametrically opposing fourth stops disposed on the housing and second counterstops disposed on the transmission member and being configured to achieve a resting position of the selection button.

31. The modular selection button as recited in claim 21 wherein the transmission member further includes at least one slot segment disposed on a front side thereof, wherein the handle includes at least one of a finger-grip knob and a rotary knob, and wherein the handle includes rib segments disposed on a rear side thereof configured to engage the at least one slot segment in a positive-locking manner.

32. The modular selection button as recited in claim 31 wherein the handle is capable of achieving at least two engagement positions with the transmission member, the at least two engagement positions being offset from each other.

33. The modular selection button as recited in claim 21 wherein the transmission member defines a light aperture.

34. The modular selection button as recited in claim 21 further comprising a cylinder lock non-rotatably connected to the housing via a cover, strip-like formations on a rear side of a core of the rotatable lock engaging in a positive locking manner with recesses defined on a front side of the transmission member, the third stop being disposed on a rear side of the cylinder lock and the third counterstop being disposed on the front side of the transmission member.

* * * * *